United States Patent [19]

Pothier

[11] Patent Number: 4,794,396

[45] Date of Patent: Dec. 27, 1988

[54] ANTENNA COUPLER VERIFICATION DEVICE AND METHOD

[75] Inventor: Robert G. Pothier, Amherst, N.H.

[73] Assignee: Sanders Associates, Inc., Nashua, N.H.

[21] Appl. No.: 720,445

[22] Filed: Apr. 5, 1985

[51] Int. Cl.[4] ..... H01Q 1/52

[52] U.S. Cl. ..... 343/703; 343/841; 174/35 R

[58] Field of Search ..... 343/703, 705, 872, 873, 343/784, 851, 841; 315/85; 174/35 R, 35 MS; 361/425; 324/158 F

[56] References Cited

U.S. PATENT DOCUMENTS

| | | | |
|---|---|---|---|
| 1,847,872 | 3/1932 | Hand . | |
| 2,293,839 | 8/1942 | Linder . | |
| 2,296,678 | 9/1942 | Linder . | |
| 2,412,562 | 12/1946 | Crawshaw . | |
| 2,490,782 | 12/1949 | Collup | 343/703 |
| 2,702,366 | 2/1955 | Ginzton | 324/58 |
| 2,724,112 | 11/1955 | Hepperle . | |
| 2,760,171 | 8/1956 | King . | |
| 2,820,127 | 1/1958 | Argento et al. | 219/10.55 |
| 2,988,740 | 6/1961 | Albanese | 343/703 |
| 3,078,461 | 2/1963 | Dwyer . | |
| 3,124,798 | 3/1964 | Zinke . | |
| 3,192,531 | 6/1965 | Cox et al. . | |
| 3,281,848 | 10/1966 | Ames et al. | 343/703 |
| 3,806,943 | 4/1974 | Holloway . | |
| 4,097,796 | 6/1978 | Lunden . | |
| 4,134,119 | 1/1979 | Sandoz et al. | 343/703 |
| 4,274,048 | 6/1981 | Tricoles et al. . | |

OTHER PUBLICATIONS

Warters, W. D., "The Effects of Mode Filters on the Transmission Characteristics of Circular Electric Waves in a Circular Waveguide", *The Bell System Technical Journal*, vol. 37, No. 3, May 1958, pp. 657-677.

Rakistraw, D., *Procedure for Handling, Installing and Testing Missile Antenna Couplers* (N.T.I.S. Accession No. AD 829109).

*Primary Examiner*—William L. Sikes

*Assistant Examiner*—Michael C. Wimer

*Attorney, Agent, or Firm*—Richard I. Seligman; Stanton D. Weinstein

[57] ABSTRACT

A device for repeatably and accurately testing an antenna coupler of the type used to connect a test antenna adjacent an onboard antenna of an aircraft to inject a test signal into the aircraft's onboard radar system to test its continuity. A base member is provided with the verification antenna mounted therein. Alignment tabs are provided on the base member for receiving points along the periphery of the antenna coupler. In a preferred embodiment, the base member is mounted inside the lid of a packing case for carrying a plurality of antenna couplers and individual alignment tabs are provided and provided with indicia for properly aligning each of the antenna couplers over the verification antenna. In another embodiment, retractable shielding is provided for electromagnetic shielding of the base member, verification antenna, and antenna coupler during operation.

55 Claims, 7 Drawing Sheets

ANTENNA COUPLER VERIFICATION DEVICE AND METHOD

BACKGROUND OF THE INVENTION

The present invention relates to antenna couplers and, more particularly, to a verification device adapted for repeatable, accurate, and convenient verification of the operability of an antenna coupler prior to its use in testing an airplane's onboard transmitter or receiver.

The environment of the present invention is shown in FIG. 1. An aircraft, generally indicated as 10, has an onboard transmitter or receiver 12 connected to a plurality of transmitting or receiving antennas 14 by transmission lines 16. The antennas 14 are disposed within radomes 18, or the like, incorporated within the skin 20 of the aircraft 10. The transmission lines 16 include directional couplers such as indicated at 22. To test the continuity of the complete system including the antennas 14, transmission lines 16, directional couplers 22, and transmitter or receiver 12, a test antenna coupler such as that generally indicated as 24 is employed. Antenna coupler 24 comprises a can or housing 26 having a peripheral portion 28 adapted to fit closely to the skin 20 of the aircraft 10 adjacent to the antenna 14 to be tested. The peripheral portion 28 is shaped such that when fit against the contours of the skin 20, a test antenna 30 is placed in alignment with the antenna 14 to be tested. The test antenna 30 is mounted within an absorptive material 32 and is connected to a connector 34 by a cable 36. A boot 29 of suitable flexible material is disposed across the peripheral portion 28 to protect the test antenna 30 from exposure to foreign debris. The system test procedure comprises attaching appropriate test apparatus (not shown) to the connector 34 and injecting a signal into the system through cavity 50 and the antenna 14 by the test antenna 30. The return signal is then analyzed to determine the continuity of the antenna 14, transmission lines 16, directional couplers 22, and transmitter or receiver 12 being tested.

The problem addressed by the present invention is testing the tester—that is, the antenna coupler 24 and the test antenna 30 contained therein must be verified as to their correct operativeness before they are used to test the antennas 14 and connecting equipment of the complete system. According to prior art techniques, a device such as that labeled 38 in FIG. 2 has been employed. Verification device 38 comprises a head 40 containing a verification antenna 42 (shown ghosted in FIG. 3). The head 40 is connected to a handle 44 to which a test cable 46 is attached internally connected to the verification antenna 42. Appropriate electronic equipment (not shown) for verifying the correct operation of the antenna coupler is connected through cable 46. Typically, an indicia 48 is placed on the head 40 in alignment with the antenna 42. In use, verification device 38 is manually aligned with the test antenna 30 by using the indicia 48. While such a device serves the purpose of verifying the antenna coupler's 24 operation, it has not proven entirely satisfactory because it cannot be repeatably positioned.

SUMMARY OF THE INVENTION

Wherefore, it is the general object of the present invention to provide a verification device for use in conjunction with antenna couplers which is easily alignable, allowing repeatably accurate use.

Another object of the present invention is to provide a verification device which is always readily available when needed.

A further object is to adapt such a device to be usable with several different types of antenna couplers.

Still another object is to allow the verification device to be used in environments which are sensitive to electromagnetic radiation.

Briefly, the present invention achieves the foregoing and other objects by mounting the verification antenna inside a base member adapted to align the coupler. The alignment is such that whenever the base member properly engages the antenna coupler, the verification antenna will have a known orientation with respect to the antenna coupler. Several alignment devices are provided, each adaptable to a different type of antenna coupler. By mounting the verification antenna inside the antenna coupler storage case, it is always available when needed. Metallic shielding of the base member and a retractable metal foil can provide adequate protection in radiation sensitive environments.

BRIEF DESCRIPTION OF THE DRAWINGS

These and further advantages and features of the present invention are described in connection with the accompanying drawings, in which.

DESCRIPTION OF THE PREFERRED EMBODIMENTS

Figure 1:
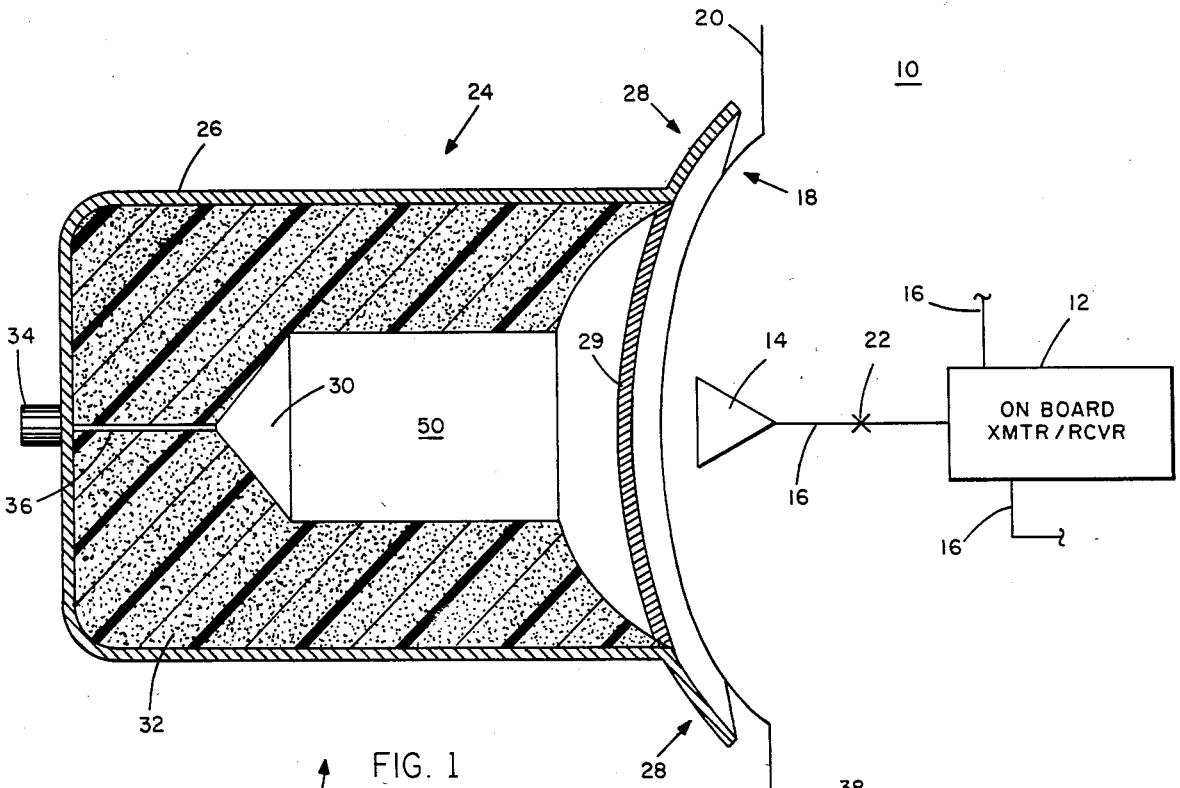
FIG. 1 PRIOR ART
FIG. 1 is a simplified cutaway drawing through a test antenna coupler placed adjacent a radome on an aircraft, showing its manner of use.
Figure 2:
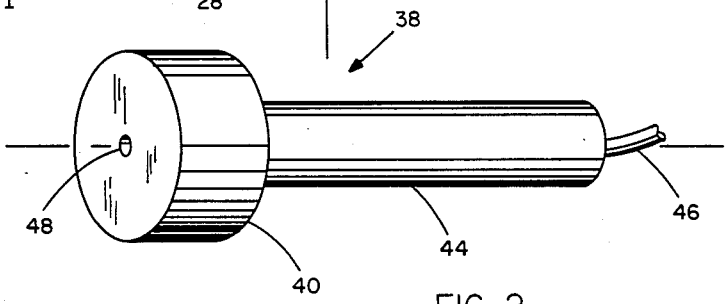
FIG. 2 is a perspective drawing of a prior art device used for verification testing of the antenna coupler of FIG. 1.
Figure 3:
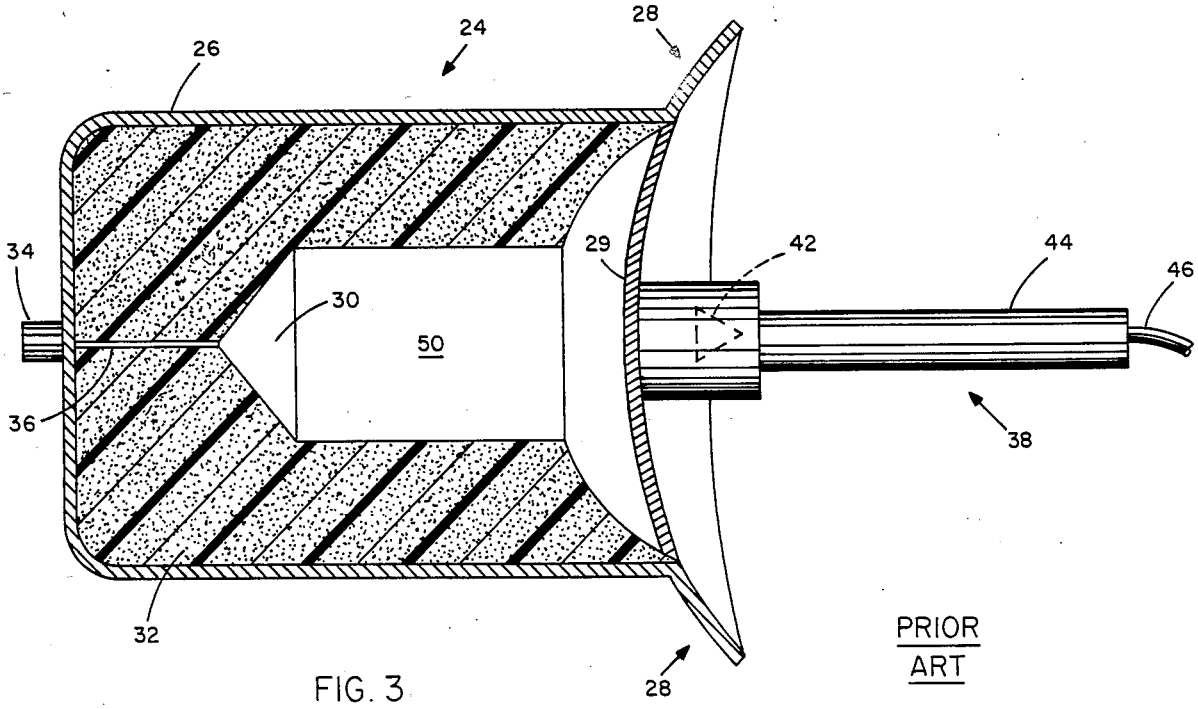
FIG. 3 PRIOR ART
FIG. 3 shows the manner of use of the device of FIG. 2 with the antenna coupler of FIG. 1.
Figure 4:
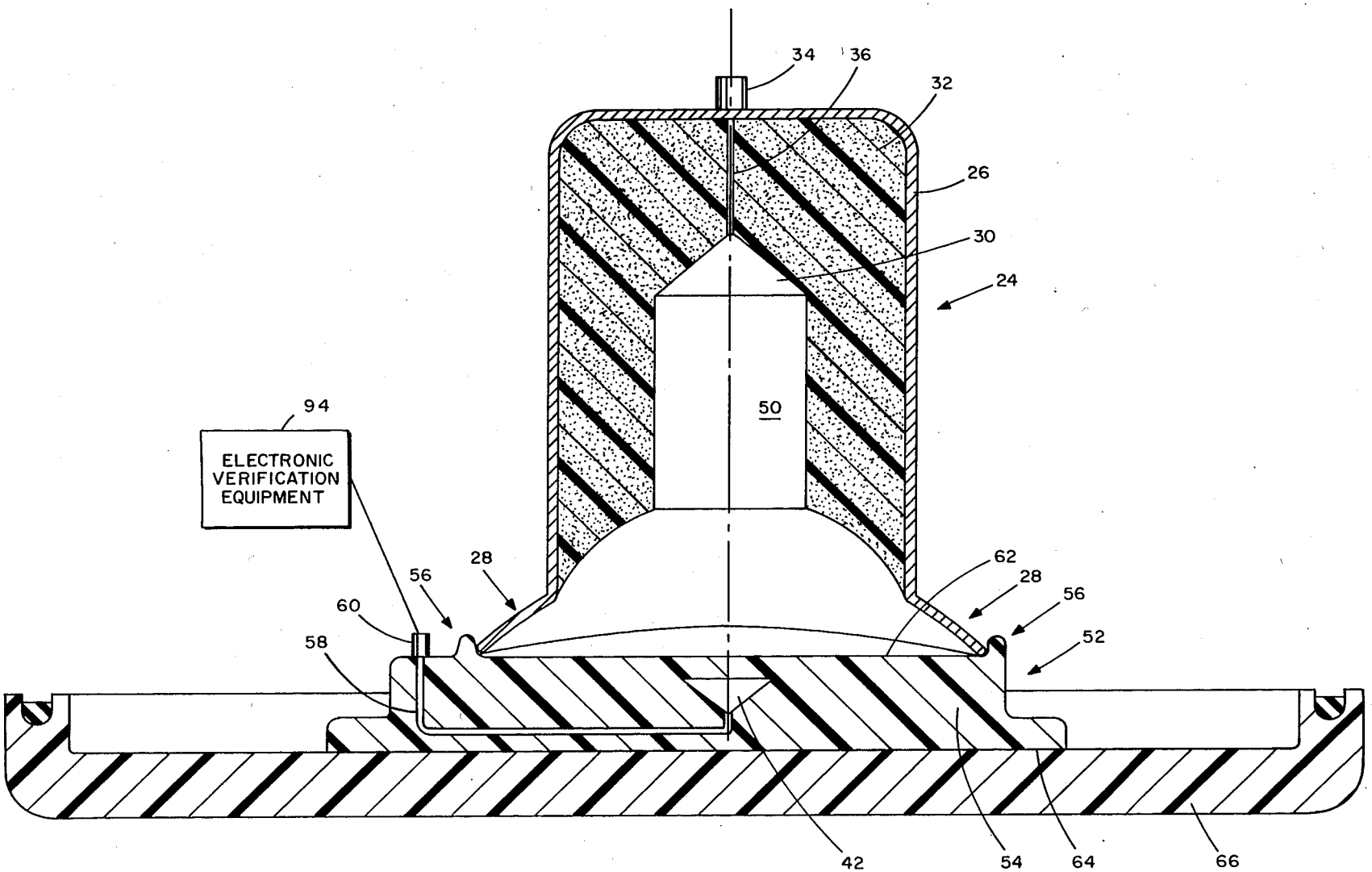
FIG. 4 is a simplified cutaway elevation of the verification device of the present invention mounted inside the lid of a carrying case for antenna couplers.

Turning now to FIG. 4, the antenna coupler verification device of the present invention is generally indicated as 52. Device 52 comprises a base member 54 having the verification antenna 42 mounted therein. Alignment means, generally indicated as 56, are provided on the base member 54 such that the antenna coupler 24 can be placed thereon and be automatically, repeatably, and precisely placed into alignment between the test antenna 30 and the verification antenna 42. The alignment means 56 will be discussed in greater detail shortly. The verification antenna 42 is connected by a cable 58 to a connector 60 outside of the area occupied by the antenna coupler 24. Base member 54 preferably has a flat lower surface 64 such that it can be mounted to the inner surface of the lid 66 of a container (not shown) adapted to hold one or more antenna couplers 24. If desired, the base member 54 could be molded into and be made part of the lid 66 during the initial fabrication process thereof. Connector 60 can provide electrical connection between antenna 42 and appropriate electronic equipment 94 for verifying the correct operation of antenna coupler 24.

Figure 5:
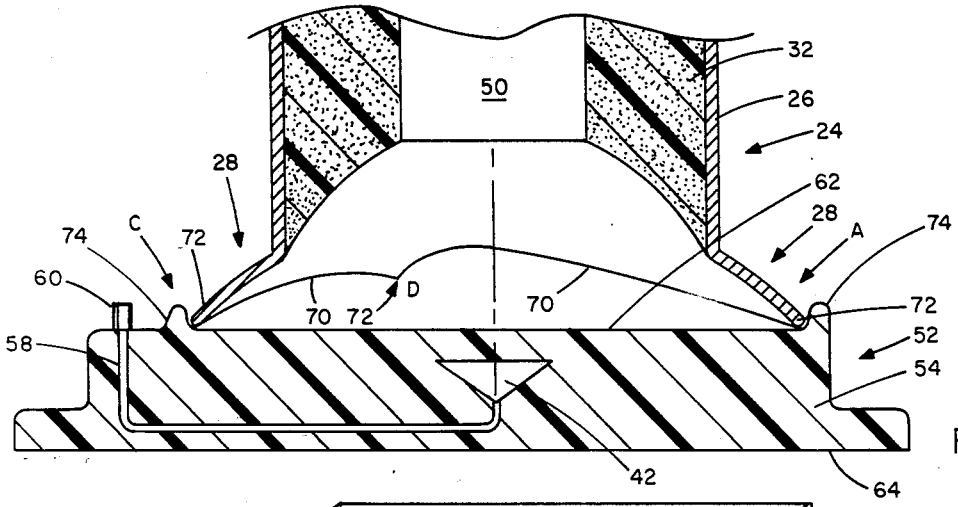
FIG. 5 is a drawing showing the manner in which point contact is made with the base member of the present invention to align the antenna coupler with the verification antenna.
Figure 6:
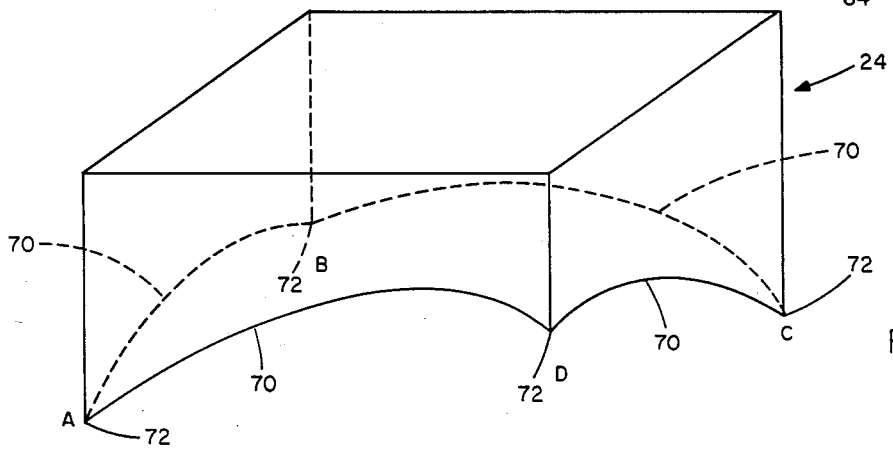
FIG. 6 is a perspective view of the bottom portion of an antenna coupler ghosted in three dimensions to show that three lower points contact a common plane.
Figure 7:
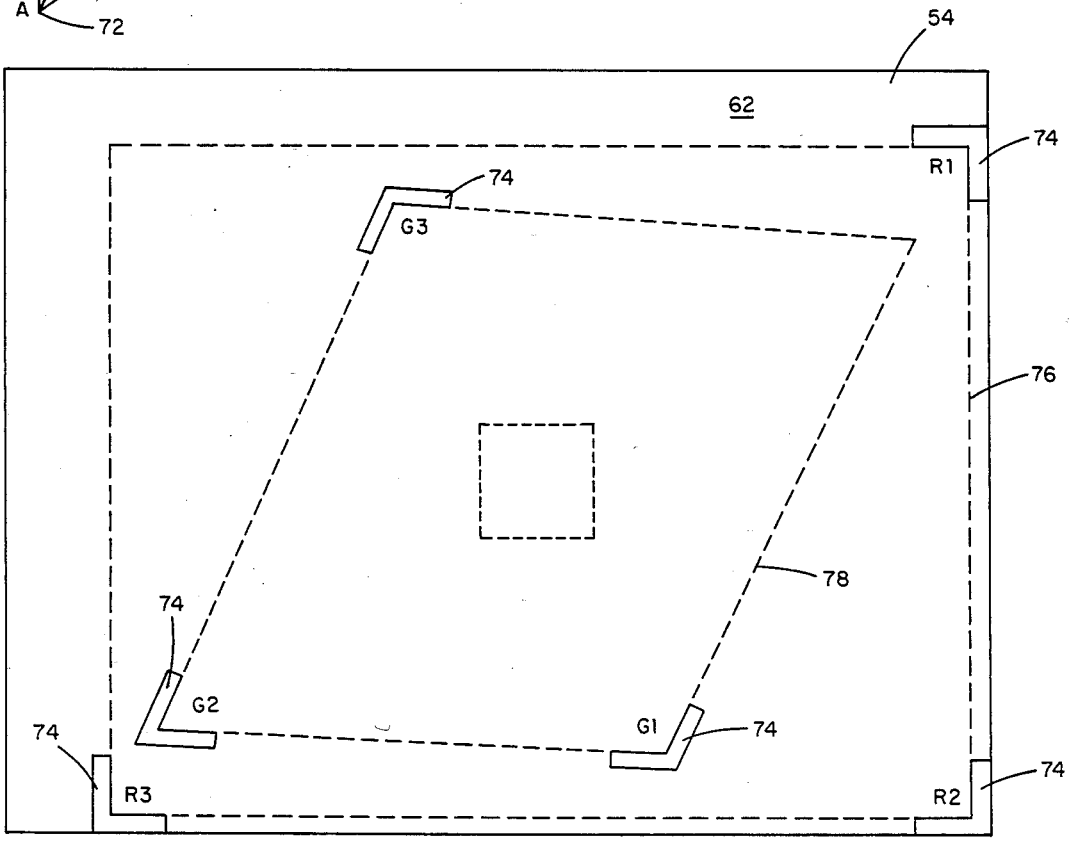
FIG. 7 shows a layout incorporated in the present invention to allow more than one antenna coupler to be used with the same base member to provide automatic alignment of each.

Turning now to FIGS. 5–7, the preferred method of alignment will be discussed in greater detail. Typically, the peripheral portion 28 of the antenna coupler 24 has curved portions 70 meeting in points 72. As seen in FIG. 6, the points 72 typically have three lowest points (designated for identification as "A", "B", and "C") with the other point or points 72 higher such as that designated as "D" in FIG. 6. The three lowest points 72 (A, B, and C) lie in a common plane. The flat upper surface 62 of the base member 54 represents such a plane. If the antenna coupler 24 is placed on to the upper surface 62, these three lowest points 72 will rest on the upper surface 62 as shown in FIG. 5 which is viewed from the point 72 designated as B. As can be seen in FIG. 5, point 72 labeled D is above the surface 62.

The manner in which this is applied according to the preferred embodiment of the present invention is best seen with respect to FIG. 7. The example of FIG. 7 is set up to do verification testing on two antenna couplers as would be housed in the carrying container. The same principle, however, would be applied to any number of antenna couplers. As shown, the alignment means 56, in each case, comprises raised tabs 74 shaped to receive the three lower points 72 on the associated antenna coupler 24. Thus, a first antenna coupler as designated by the dotted line 76 is adapted to be positioned by the raised tabs 74 designated with indicia on the surface 62 "R1", "R2", and "R3". For example, this could stand for Red One, Red Two and Red Three, with similar indicia applied to the appropriate corners of the antenna coupler 24. A second coupler as indicated by the dotted line 78 is adapted to be received and positioned by the raised tabs 74 designated by indicia "G1", "G2", and "G3". This could correspond to matching indicia on the points 72 of the second antenna coupler 24 as in Green One, Green Two, and Green Three. Note that the verification antenna 42 as indicated by the dotted block is coaxial with both the first and second coupler dotted line 76, 78.

Figure 8:
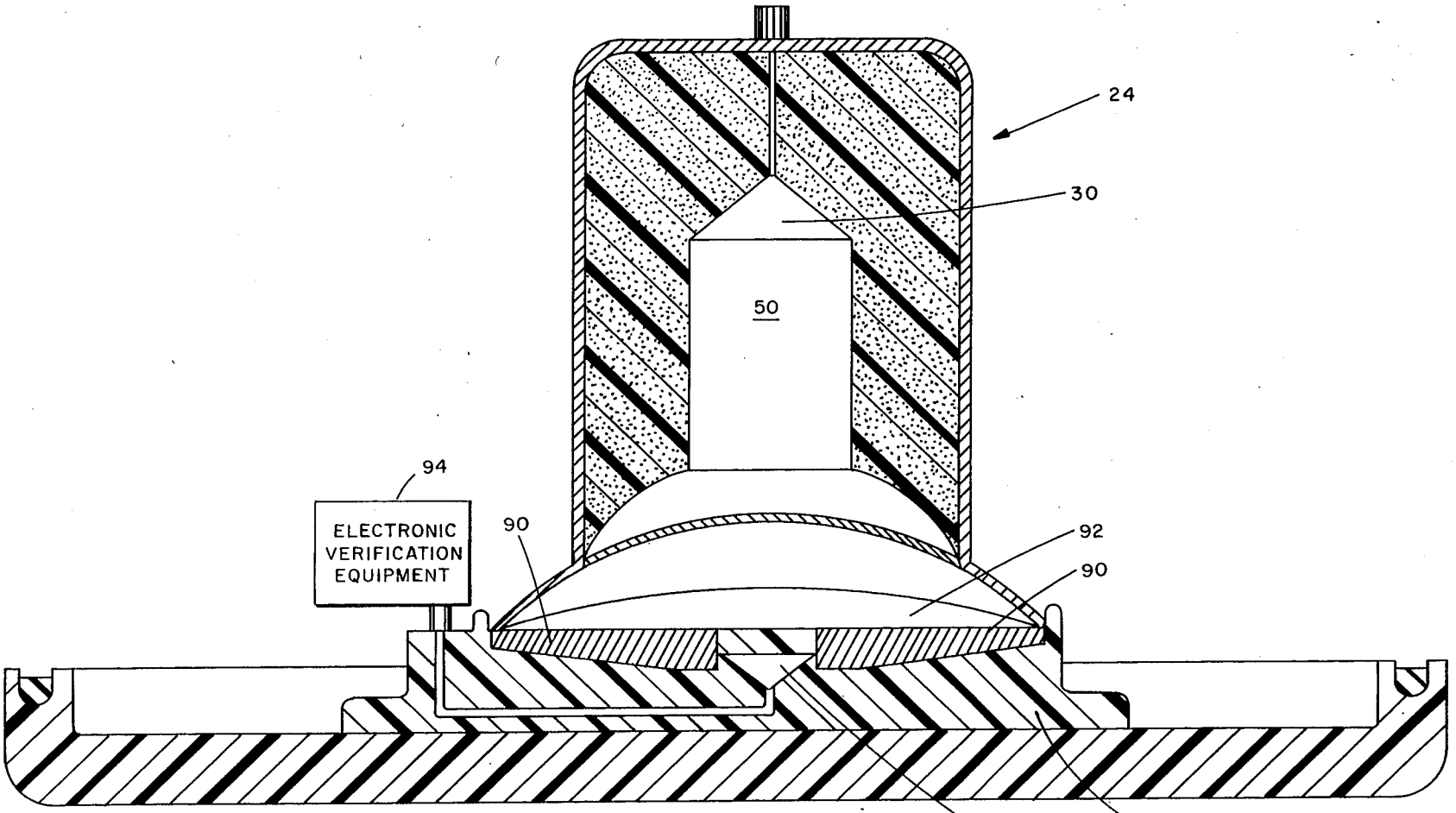
FIG. 8 is a simplified cutaway elevation similar to FIG. 4 but showing an alternate embodiment of the present invention.

FIG. 8 shows an alternate embodiment of the base member 54. This embodiment would be used when the near field characteristics of verification antenna 42 and test antenna 30 are such to cause multiple signal reflections. In such an instance, absorptive material 90 is disposed about verification antenna 42 to attenuate such reflected signals without interfering with the correct operation of the verification antenna 42. In the embodiment shown, the absorptive material 90 would be ring-shaped. Additionally, absorptive material 90 may comprise a ferrite material whose absorptive properties extend into the air gap 92 created between the contours of the periphery of the antenna coupler 24 and base member 54. Microwave Absorber Type 9497 marketed by Plessey, Incorporated of Melville, N.Y. is the preferred ferrite having this property.

Figure 9:
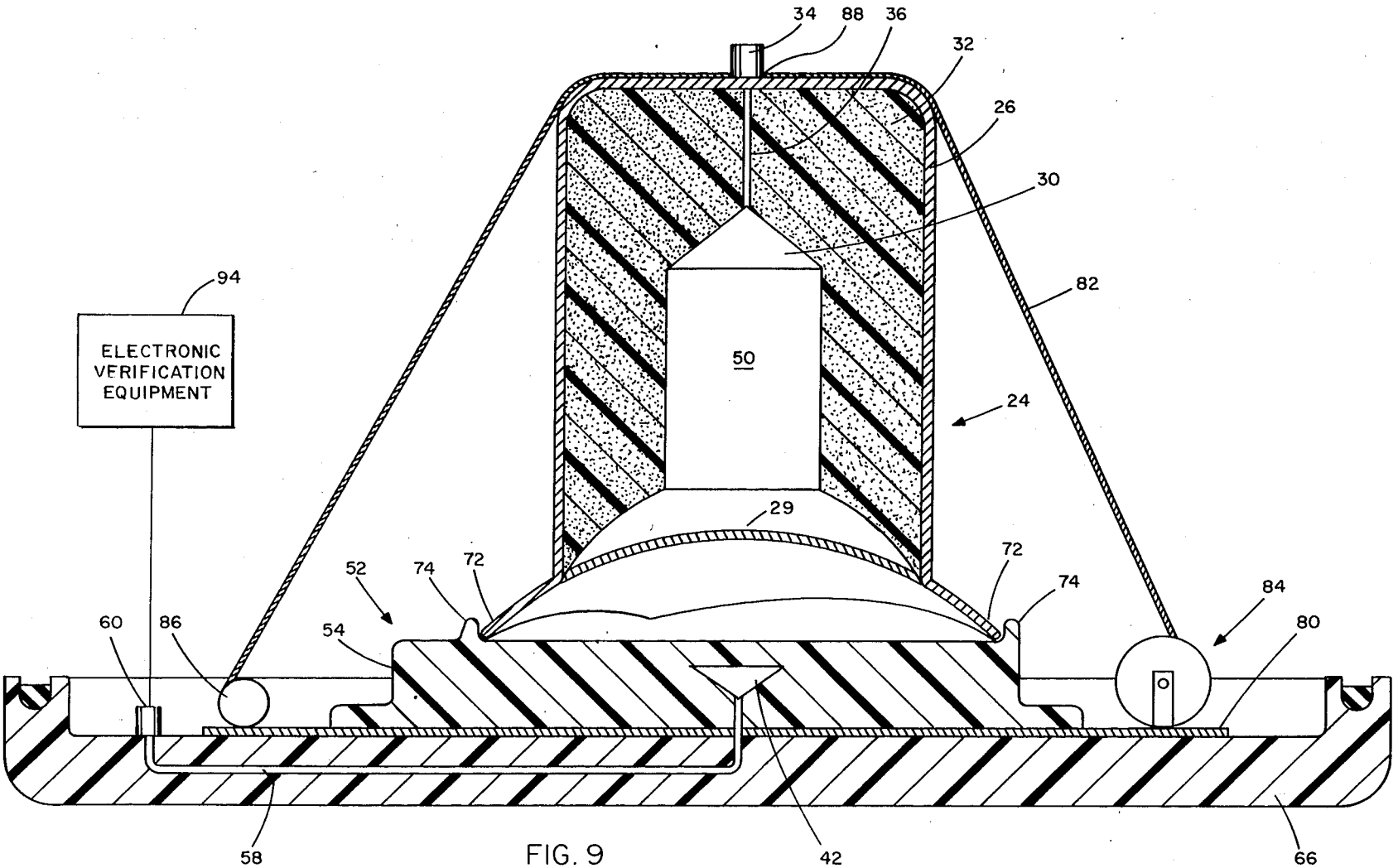
FIG. 9 is a simplified cutaway elevation of another alternate embodiment of the present invention with retractable shielding provided.
Figure 10:
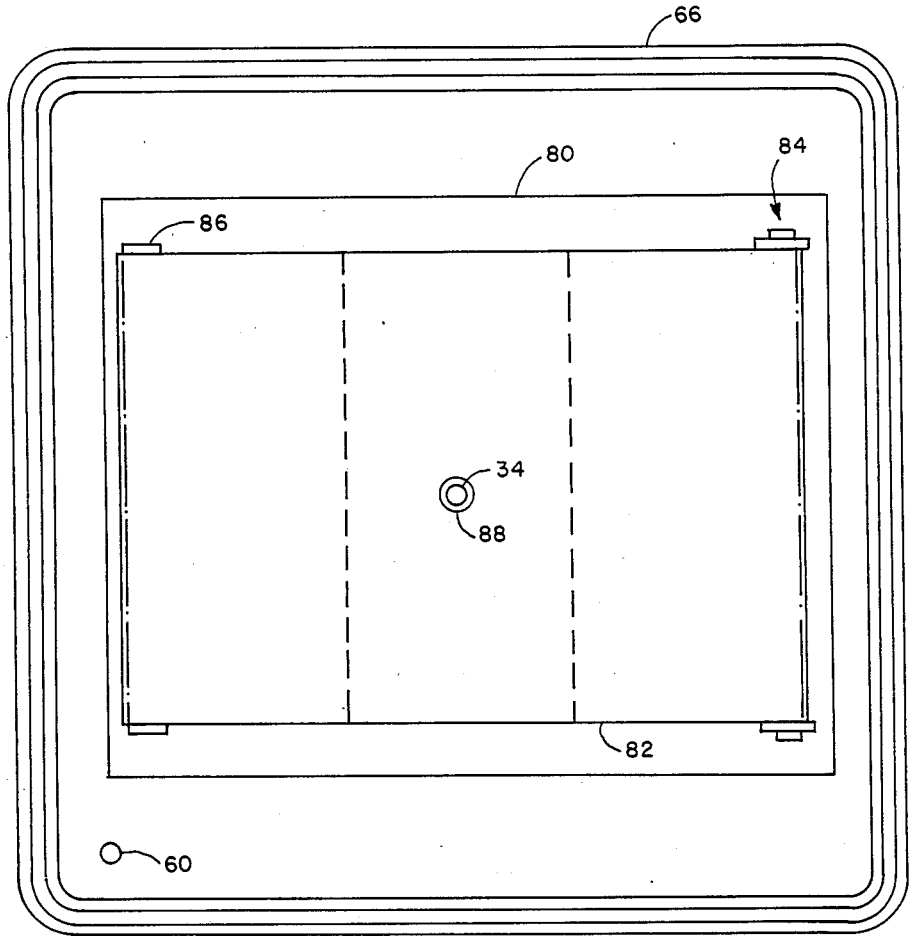
FIG. 10 is a top view of the apparatus of FIG. 9.
Figure 11:
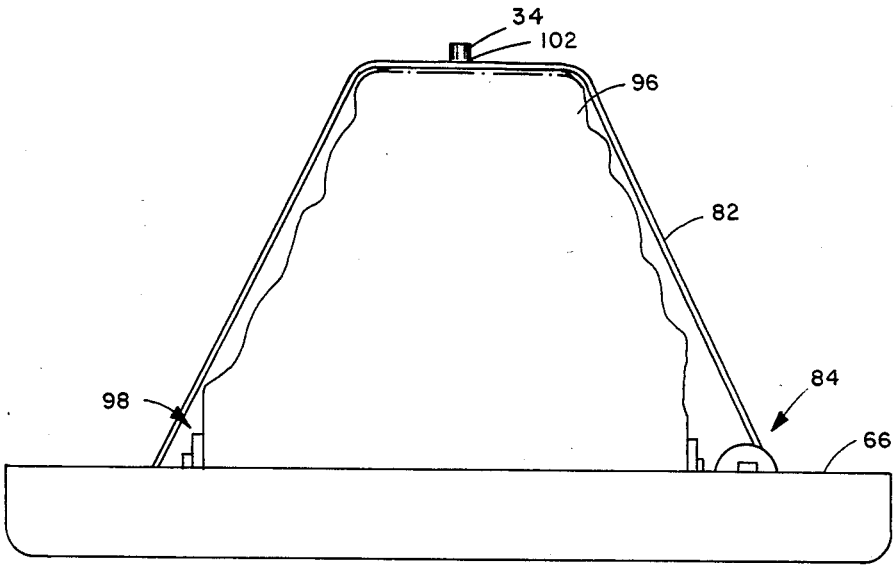
FIG. 11 is a side elevation of still another alternate embodiment of the present invention with retractable shielding provided.
Figure 12:
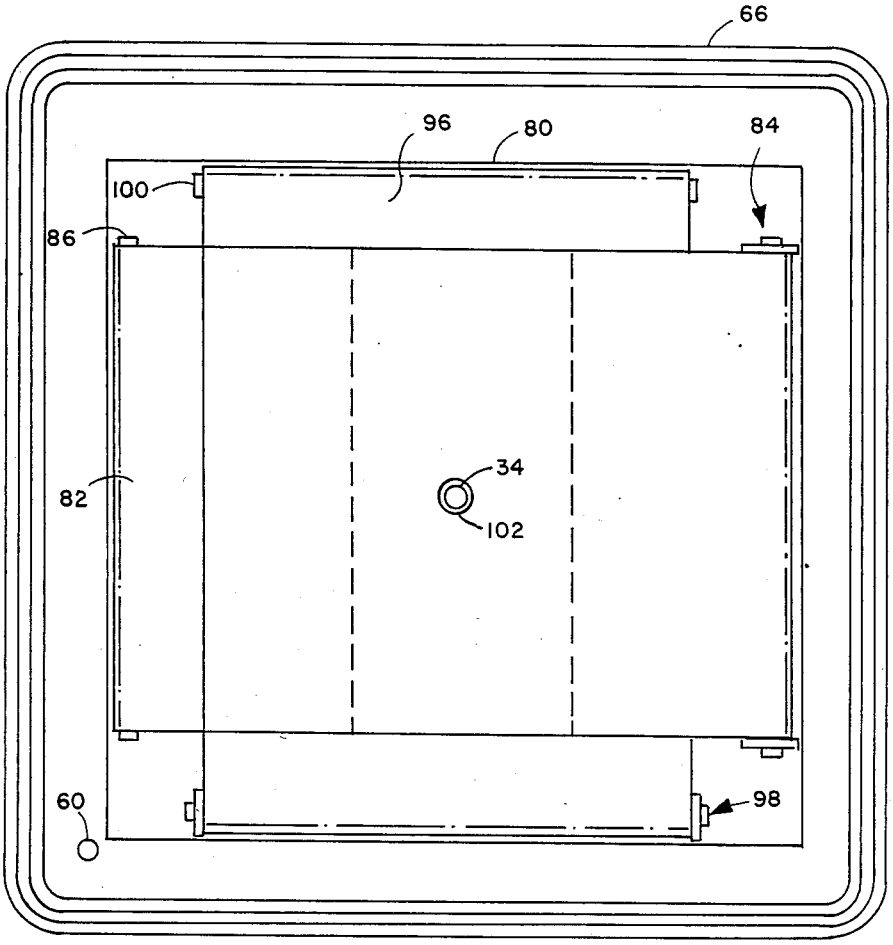
FIG. 12 is a top view of the apparatus of FIG. 11.

Turning now to FIGS. 9 and 10, an alternate embodiment is shown for conditions where electromagnetic radiation is a problem. In this case, a metal plate or foil sheet 80 is disposed between the base member 54 and the lid 66. The cable 58 is routed through the metal plate 80 to a connector 60 disposed in a position removed from the area of the metal plate 80 and base member 54. A retractable metal foil or resistive screen 82 is mounted to the metal plate 80 on one side on a rolling device 84 and to a releasable stretcher bar 86 on the opposite side. The screen/metal foil 82 could also be folded or the like. A hole 88 is positioned to go over the connector 34 allowing access thereto. After the antenna coupler 24 is placed on to the base member 54, the metal screen/foil 82 is unrolled from the device 84, stretched over the coupler 24, and held in place by attaching the bar 86 to the metal plate 80. As shown in FIGS. 11 and 12, for more complete shielding, a second screen/foil 96 can be disposed at ninety degrees to the first screen/foil 82 so as to more completely envelope the coupler 24 when they are placed in their operable position.

A second retractable metal foil or resistive screen 96 is mounted to the metal plate 80 on one side on a rolling device 98 and to a releasable stretcher bar 100 on the opposite side. The second screen/metal foil 96 could also be folded or the like. A hole 102 is positioned to go over the connector 34 allowing access thereto. After the antenna coupler 24 is placed onto the base member 54, and the first metal screen/foil 82 is unrolled from the device 84 stretched over the coupler 24, and held in place by attaching the bar 86 to the metal plate 80, the second metal screen/foil 96 is unrolled from the device 98, stretched over the coupler 24, and held in place by attaching the bar 100 to the metal plate 80.

Thus it can be seen that the various embodiments of the present invention as described above meet their stated objectives by providing a simple and reliable way for repeatably positioning a test antenna coupler for verification of its correct operation.

Moreover, by incorporating the verification device within the carrying case for the antenna couplers and providing means for aligning all of the couplers being carried in the case, the verification device is always readily available for use.

Other advantages and modifications of the present invention may be possible and evident to those skilled in the art. Therefore, it should be understood that the intent is to limit the present invention only by the scope of the claims which follow.

Wherefore, I claim:

1. Apparatus for verification of operability of an antenna coupler that includes an antenna, said apparatus comprising:

a base member;

a first antenna mounted in said base member and substantially aligned with a first axis;

a plurality of first members connected to said base member and each configured to receive a respective one of a like plurality of corner points of a first antenna coupler of first configuration and first size for contacting the first antenna coupler upon placement of the first antenna coupler against said base member, and for repeatably aligning the first antenna coupler substantially along the first axis; and a plurality of second members connected to said base member and each configured to receive a respective one of a like plurality of corner points of a second antenna coupler of second configuration and second size for contacting the second antenna coupler upon placement of the second antenna coupler against said base member in lieu of the first antenna coupler, and for repeatably aligning the second antenna coupler substantially along the first axis, whereby an antenna coupler of any of a plurality of configurations can be repeatably aligned on said base member with the first axis.

2. The apparatus of claim 1 wherein:

said base member is incorporated into the inside of the lid of a case adapted to hold at least one of the first and second antenna couplers.

3. The apparatus of claim 1, further comprising:

means, disposed on said base member, for electromagnetic shielding of said first antenna.

4. The apparatus of claim 1 wherein said base member further comprises:

means for absorbing signal reflections created during operation of said first antenna.

5. The apparatus of claim 1, further comprising:

(a) first indicia associated with said plurality of first members for identifying each of said plurality of first members individually; and (b) second indicia associated with said plurality of second members for identifying each of said plurality of second members individually, whereby each of the antenna couplers can be quickly and repeatably positioned with its associated members.

6. The apparatus of claim 1 wherein said first antenna comprises a verification antenna.

7. The apparatus of claim 1 wherein:

said base member includes a substantially flat surface; and said plurality of first members and said plurality of second members are disposed on said substantially flat surface.

8. The apparatus of claim 1, further comprising:

means carried by said base member for electrically connecting said first antenna to electronic verification equipment.

9. The apparatus of claim 1, further comprising:

a connector electrically connected to said first antenna.

10. The apparatus of claim 9 wherein said connector is disposed on said base member.

11. The apparatus of claim 9 wherein:

said base member includes a substantially flat surface; and said plurality of first members, said plurality of second members and said connector are disposed on said substantially flat surface.

12. The apparatus of claim 1 wherein:

said plurality of first members are substantially coplanar; and said plurality of second members are substantially coplanar with said plurality of first members.

13. The apparatus of claim 4 wherein said means for absorbing comprises:

absorptive material disposed about said first antenna.

14. The apparatus of claim 1 wherein:

said plurality of first members are substantially coplanar; and said plurality of second members are substantially coplanar.

15. The apparatus of claim 1 wherein:

said plurality of first members are each configured to restrict lateral movement of a respective one of the like plurality of corner points of the first antenna coupler; and said plurality of second members are each configured to restrict lateral movement of a respective one of the like plurality of corner points of the second antenna coupler.

16. The apparatus of claim 1 wherein:

said plurality of first members and said plurality of second members comprise projections from said base member.

17. Apparatus for verification of operability of an antenna coupler that includes an antenna, said apparatus comprising:

a base member;

first alignment means connected to said base member for contacting a first antenna coupler when placed against said base member and for repeatably aligning the first antenna coupler substantially along a preestablished axis;

a first antenna mounted in said base member and substantially aligned with the axis;

a flexible conductive member;

means, connected to said base member and to said flexible member, for reversibly rolling up said flexible member; and connector means, connected to a portion of said flexible member disposed opposite from connection of said flexible member to said means for rolling, for releasably connecting said flexible member to said base member, whereby said means for rolling and said connecting means can releasably hold said flexible member in position to provide electromagnetic shielding for said apparatus and for the antenna coupler.

18. The apparatus of claim 17 wherein said flexible conductive member comprises a flexible metal sheet.

19. The apparatus of claim 17 wherein said flexible conductive member comprises a flexible metallic member.

20. The apparatus of claim 17 wherein said flexible conductive member comprises a resistive screen.

21. The apparatus of claim 17, further comprising:

a second flexible conductive member;

second means, connected to said base member and to said second flexible member, for reversibly rolling up said second flexible member; and second connector means, connected to a portion of said second flexible member disposed opposite from connection of said second flexible member to said second means for rolling, for releasably connecting said second flexible member to said base member, whereby said second means for rolling and said second connector means can releasably hold said second flexible member in position at an angle to said flexible member to provide additional shielding for said apparatus and for the antenna coupler.

22. Apparatus for verification of operability of an antenna coupler that includes an antenna, said apparatus comprising:

a base member;

first alignment means connected to said base member for contacting a first antenna coupler when placed against said base member and for repeatably aligning the first antenna coupler substantially along a preestablished axis;

a first antenna mounted in said base member and substantially aligned with the axis;

a flexible conductive member;

a conductive member disposed on said base member opposite said first alignment means;

means, connected to said conductive member and to said flexible conductive member, for reversibly rolling up said flexible member; and connector means, connected to a portion of said flexible conductive member disposed opposite from connection of said flexible conductive member to said means for rolling, for releasably connecting said flexible conductive member to said conductive member, whereby said means for rolling and said connector means can releasably hold said flexible conductive member in position to provide electromagnetic shielding for said apparatus and for the antenna coupler.

23. The apparatus of claim 22 wherein said flexible conductive member comprises a flexible metal sheet.

24. The apparatus of claim 22 wherein said conductive member comprises a metal plate.

25. The apparatus of claim 22 wherein said conductive member comprises a foil sheet.

26. The apparatus of claim 22 wherein said flexible conductive member comprises a flexible metallic member.

27. The apparatus of claim 22 wherein said flexible conductive member comprises a resistive screen.

28. The apparatus of claim 22 wherein said conductive member comprises a metal member.

29. The apparatus of claim 22, further comprising:

a second flexible conductive member;

a second conductive member disposed on said base member opposite said first alignment means;

second means, connected to said second conductive member and to said second flexible conductive member, for reversibly rolling up said second flexible conductive member; and second connector means, connected to a portion of said second flexible conductive member disposed opposite from connection of said second flexible conductive member to said second means for rolling, for releasably connecting said second flexible conductive member to said second conductive member, whereby said second means for rolling and said second connector means can releasably hold said second flexible conductive member in position at an angle to said flexible member to provide additional shielding for said apparatus and for the antenna coupler.

30. Apparatus for verification of operability of an antenna coupler that includes an antenna, said apparatus comprising:

a first member;

a first antenna mounted in said first member and substantially aligned with a first axis;

a first plurality of members, each configured to receive a respective one of a like number of physical features of a first antenna coupler, connected to said first member and arranged about the first axis to repeatably align the first antenna coupler substantially along the first axis upon placement of the first antenna coupler against said first member; and a second plurality of members, each configured to receive a respective one of a like number of physical features of a second antenna coupler of different size than the first antenna coupler, connected to said first member and arranged about the first axis to repeatably align the second antenna coupler substantially along the first axis upon placement of the second antenna coupler against said first member.

31. The apparatus of claim 30 wherein:

said first member is incorporated into the inside of the lid of a case adapted to hold the first antenna coupler.

32. The apparatus of claim 30 wherein said first antenna comprises a verification antenna.

33. The apparatus of claim 30 wherein said first member comprises a base member.

34. The apparatus of claim 30, further comprising a connector electrically connected to said first antenna and disposed on said first member.

35. The apparatus of claim 30 wherein:

said first member includes a substantially flat surface;

said first plurality of members are connected to and extend from said substantially flat surface; and said second plurality of members are connected to and extend from said substantially flat surface.

36. The apparatus of claim 30 wherein:

said first plurality of members are substantially coplanar; and said second plurality of members are substantially coplanar.

37. The apparatus of claim 30 wherein:

said first plurality of members are each configured to restrict lateral movement of a respective one of the like number of physical features of the first antenna coupler; and said second plurality of members are each configured to restrict lateral movement of a respective one of the like number of physical features of the second antenna coupler.

38. The apparatus of claim 30 wherein:

said first plurality of members and said second plurality of members comprise projections from said first member.

39. Apparatus for electromagnetic shielding of an object, comprising:

a flexible conductive member;

a conductive member;

means, connected to said conductive member and to said flexible conductive member, for reversibly rolling up said flexible member; and connector means, connected to a portion of said flexible conductive member disposed opposite from connection of said flexible conductive member to said means for rolling, for releasably connecting said flexible conductive member to said conductive member, whereby said means for rolling and said connector means can releasably hold said flexible conductive member in position to provide shielding for an object.

40. The apparatus of claim 39 wherein said flexible conductive member comprises a flexible metal sheet.

41. The apparatus of claim 39 wherein said conductive member comprises a metal plate.

42. The apparatus of claim 39 wherein said conductive member comprises a foil sheet.

43. The apparatus of claim 39 wherein said flexible conductive member comprises a flexible metallic member.

44. The apparatus of claim 39 wherein said flexible conductive member comprises a resistive screen.

45. The apparatus of claim 39 wherein said conductive member comprises a metal member.

46. The apparatus of claim 39, further comprising:

a second flexible conductive member;

a second conductive member;

second means, connected to said second conductive member and to said second flexible conductive member, for reversibly rolling up said second flexible conductive member; and second connector means, connected to a portion of said second flexible conductive member disposed opposite from connection of said second flexible conductive member to said second means for rolling, for releasably connecting said second flexible conductive member to said second conductive member, whereby said second means for rolling and said second connector means can realeasably hold said second flexible conductive member in position at an angle to said flexible member to provide additional shielding for the object.

47. Apparatus for axial alignment of any of a plurality of antenna couplers, comprising:

a first member;

a first antenna connected to said first member and having a first axis;

a first plurality of members connected to and extending from said first member and arranged in a first arrangement about said first axis to contact respective portions of a first antenna coupler of a first configuration; and a second plurality of members connected to and extending from said first member and arranged in a second arrangement, smaller than said first arrangement, about said first axis to contact respective portions of a second antenna coupler of a second configuration.

48. The apparatus of claim 47 wherein:

said first member is incorporated into the inside of the lid of a case adapted to hold the first antenna coupler.

49. The apparatus of claim 47 wherein said first antenna comprises a verification antenna.

50. The apparatus of claim 47 wherein said first member comprises a base member.

51. The apparatus of claim 47, further comprising a connector electrically connected to said first antenna and disposed on said first member.

52. The apparatus of claim 47 wherein:

said first member includes a substantially flat surface;

said first plurality of members are connected to and extend from said substantially flat surface; and said second plurality of members are connected to and extend from said substantially flat surface.

53. The apparatus of claim 47 wherein:

said first plurality of members are substantially coplanar; and said second plurality of members are substantially coplanar.

54. The apparatus of claim 47 wherein:

said first plurality of members are each configured to restrict lateral movement of a respective one of the respective portions of the first antenna coupler; and said second plurality of members are each configured to restrict lateral movement of a respective one of the respective portions of the second antenna coupler.

55. The apparatus of claim 47 wherein:

said first plurality of member and said second plurality of members comprise projections from said first member.

* * * * *